United States Patent [19]

Ewert

[11] Patent Number: 5,033,170

[45] Date of Patent: Jul. 23, 1991

[54] SNAP-ON FASTENER FOR WEB-LIKE ARTICLES

[76] Inventor: Abram Ewert, 6651 Brooks Street, Vancouver, B. C., Canada, V5S 3J6

[21] Appl. No.: 100,890

[22] Filed: Sep. 25, 1987

[30] Foreign Application Priority Data

Nov. 25, 1986 [CA] Canada ..... 523783

[51] Int. Cl.[5] ..... A44B 1/04

[52] U.S. Cl. ..... 24/459; 24/462

[58] Field of Search ..... 24/459, 72.5, 470, 474, 24/464, 462

[56] References Cited

U.S. PATENT DOCUMENTS

| | | | |
|---|---|---|---|
| 371,035 | 10/1887 | Crandall | 24/459 X |
| 697,808 | 4/1902 | Chauvet . | |
| 806,521 | 12/1905 | Childs . | |
| 1,399,730 | 12/1921 | Abe . | |
| 1,560,020 | 3/1913 | Graham . | |
| 1,578,563 | 6/1926 | Swinland . | |
| 1,602,305 | 10/1926 | Helm . | |
| 1,828,041 | 10/1931 | Hamacher . | |
| 2,041,498 | 5/1936 | Widersky . | |
| 2,939,195 | 6/1960 | Carlson . | |
| 3,557,410 | 1/1971 | Van Buren . | |

FOREIGN PATENT DOCUMENTS

| | | | |
|---|---|---|---|
| 170130 | 1/1952 | Austria | 24/459 |
| 527127 | 10/1956 | Belgium | 24/459 |
| 1472073 | 3/1967 | France | 24/459 |
| 94259 | 7/1959 | Norway | 24/459 |
| 132500 | 7/1951 | Sweden | 24/459 |
| 189038 | 4/1964 | Sweden | 24/459 |
| 192519 | 11/1964 | Sweden | 24/459 |

*Primary Examiner*—Laurie K. Cranmer

*Attorney, Agent, or Firm*—Kelly Bauersfeld & Lowry

[57] ABSTRACT

This invention is directed to an all-purpose fastener which can grip securely web and fabric-type articles without puncturing or damaging the articles. A fastening apparatus for gripping web-like materials comprising a central member which is placed on one side of the web-like material; and, an outer member which corresponds generally in shape with the central member, is placed on the opposite side of the web-like material and fits over the central member and the web-like material, the central member and the outer member cooperating together to grip the web-like material.

4 Claims, 2 Drawing Sheets

SNAP-ON FASTENER FOR WEB-LIKE ARTICLES

FIELD OF THE INVENTION

This invention is directed to an all-purpose fastener which can grip securely web and fabric-type articles without puncturing or damaging the articles.

BACKGROUND OF THE INVENTION

Most, if not all fasteners, for securing ropes, cords and other securing devices to a broad flat flexible article such as a plastic film, a tarpaulin, a sheet, a woven fabric, or the like, pass through, puncture or penetrate the article thereby leaving a permanent hole or opening in the article. Fasteners which do not puncture the article, especially if it is constructed of a slippery material, do not provide good strong gripping action on such articles.

The applicant is aware of the following patents which disclose assorted types of fasteners.

| U.S. Pat. No. | Issue Date | Inventor |
|---|---|---|
| 697,808 | April 15, 1902 | Chauvet |
| 806,521 | December 5, 1905 | Childs |
| 1,560,020 | March 18, 1913 | Graham |
| 1,399,730 | December 13, 1921 | Abe |
| 1,578,563 | June 8, 1926 | Swinland |
| 1,602,305 | October 5, 1926 | Helm |
| 1,828,041 | October 20, 1931 | Hamacher |
| 2,041,498 | May 19, 1936 | Swidersky |
| 2,939,195 | June 7, 1960 | Carlson |
| 3,557,410 | January 26, 1971 | Van Buren |

Graham, Abe, Helm, and Van Buren all disclose inventions wherein a web-like material is secured by snapping an annulus over a piece of the material stretched over a hub. However, these patents all provide for support means (such as the strap 18 in Van Buren) to be connected to the hub rather than to the annulus. Chauvet discloses support means connected to the annulus but neither the hub nor the annulus are flexible. Connection of the two is accomplished by insertion of the annulus and rotation thereof in order to lock the hub over a protrusion in the annulus.

SUMMARY OF THE INVENTION

This invention is directed to a snap-on type fastener constructed of flexible plastic which can be used for fastening a rope, tether, or similar type article to plastic film, woven fabric, or similar type flexible web-like articles, without penetrating or puncturing the web-like article. The fastener consists of a snap-in type button and a surrounding flexible elastic frame into which the button is snapped.

An important advantage of the fastener is that it does not punch a hole in the web-like article in order to achieve a strong gripping action on the article. Another advantage is that the fastener can be affixed to any part of the article, not necessarily the edge region of the article. The fastener, can be used in a wide variety of applications, for example, gripping plastic garbage bags, securing tents with stakes, and stretching woven nylon tarpaulins over loaded trucks or automobiles.

A fastening apparatus for gripping web-like materials comprising: a central member which is placed on one side of the web-like material; and, an outer member which corresponds generally in shape with the central member, is placed on the opposite side of the web-like material, and fits over the central member and the web-like material, the central member and the outer member cooperating together to grip the web-like material.

In the apparatus, the central member may be circular in shape. The circular central member may have a groove extending around its circumference.

In the apparatus, the outer member may have an opening therein which is adapted to receive the central member. The outer member may have a rim which extends around at least a portion of the opening, the rim being adapted to fit within the groove of the central member. The outer member may also have within its opening an inwardly extending projection which on its free end fits within the groove of the central member.

In the apparatus, the interior edge of the rim, and the free end of the projection may be circular, and have the same general radius of curvature. The outer member may have therein a second opening removed from the inner member receiving opening.

DRAWINGS

In the drawings which illustrate specific embodiments of the invention, but which should not be regarded as restricting the scope of the invention in any way:

DETAILED DESCRIPTION OF A SPECIFIC EMBODIMENT OF THE INVENTION

Figure 1:
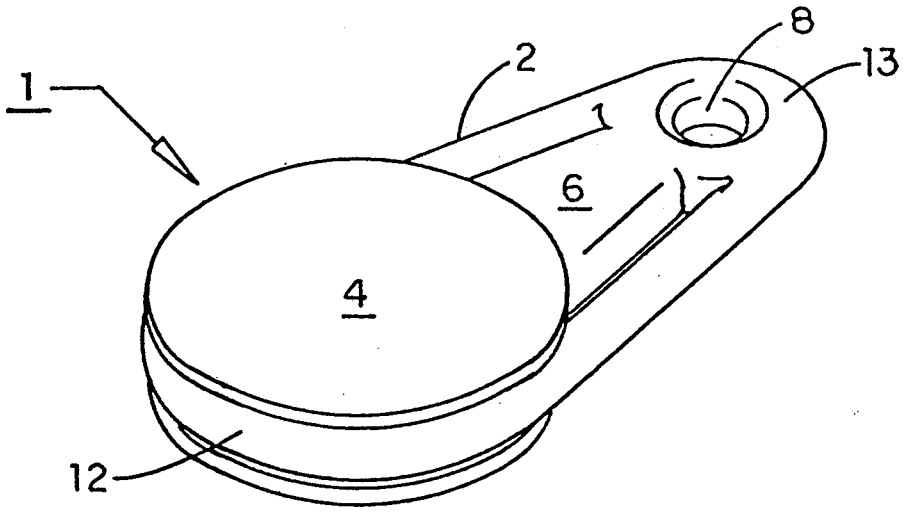
FIG. 1 represents a perspective view of the snap-on fastener.
Figure 2:
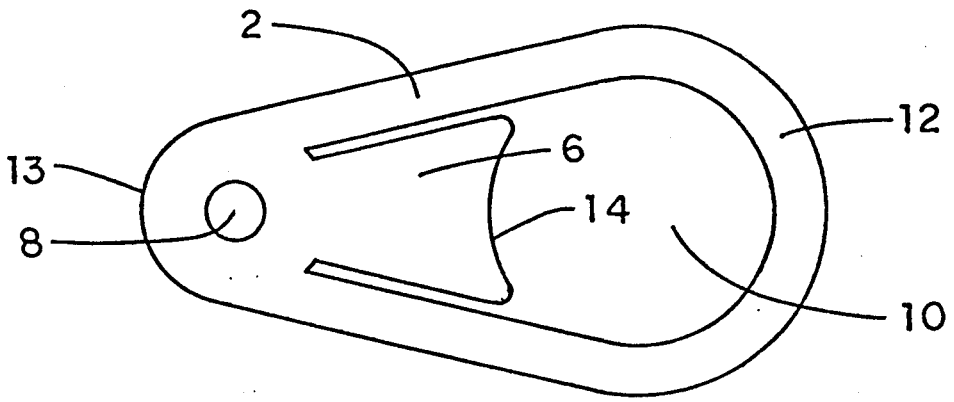
FIG. 2 represents a top view of the outer frame of the snap-on fastener.

Referring to the drawings, and initially to FIG. 1, which illustrates a perspective view of the snap-on fastener 1, it can be seen that the fastener 1 is relatively simple in construction, basically comprising two parts, that is a surrounding flexible elastic frame 2 with a central opening therein, and a center circular button 4 which fits within the frame 2. As seen in FIG. 2, the frame 2 has a general tapered oval shape with a large semicircular end 12, which blends into a pair of straight leg portions extending in converging relation to an opposite narrow circular end 13. A large circular opening 10 is enclosed within the large semicircular end 12. The frame 2 has a flexible center tongue 6 which extends inwardly from the narrow portion 13 of the frame 2 in the direction of the large center opening 10 with the tongue having a cross sectional width extending between the frame leg portions wherein such tongue width is substantially greater than the widths of the frame leg portions and wherein the tongue width increases in a direction away from the narrow portion 13 such that the tongue substantially fills the space between the straight leg portions. The frame 2 has a center hole 8 penetrating through its narrow end 13. The inner edge 14 of the flexible tongue 6 opposite the hole 8 is concave. The radius of curvature of the concave portion of tongue 6 is generally the same as the radius of curvature of the large opening 10.

Figure 3:
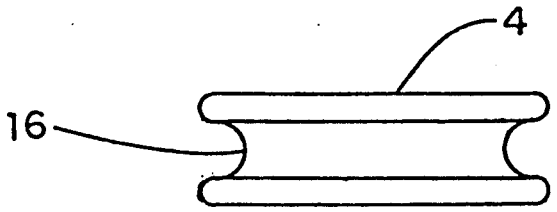
FIG. 3 represents a side elevation view of the snap-on member of the fastener.

As can be seen in FIG. 3, which illustrates the button 4 in side elevation view, the circular button 4 has a concave groove 16 formed around its circumferencial edge. The radius of this circular concave groove 16 generally corresponds with the radius of curvature of the concave end of tongue 6 and the inner circular portion of opening 10, but should be slightly smaller in order to accommodate the thickness of the article which is to be gripped by the fastener 1.

Figure 4:
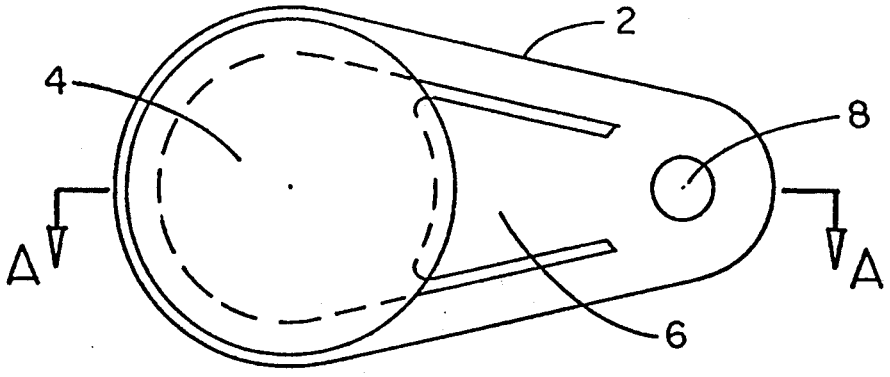
FIG. 4 represents a top view of the snap-on fastener with the snap-on inner member in place inside the outer frame.

The frame 2 is preferably made of a flexible resilient slightly elastic material such as low density polyethylene. It is important that the frame 2 be sufficiently elastic in nature to permit button 4 and overlying fabric to be snapped inside it. The button 4 can be made of a resilient material similar to the frame 2 but it is not as important that it be elastic in nature. As can be seen in FIG. 4, the center button 4 snaps into the opening 10 created by circular end 12. The circular end or rim 12 cooperates with tongue 6 to fit within groove 16 and thereby securely grip button 4. Rim 12 and tongue 6 must be constructed of a material which is sufficiently elastic in quality to enable the button 4 to be snapped by hand into place within opening 10, but at the same time the material must be sufficiently strong and rigid to provide a secure grip that does not permit the button 4 and fabric being gripped by the fastener 1 to be easily pulled or snapped out of the opening 10 formed by rim 12 and tongue 6.

Figure 5:
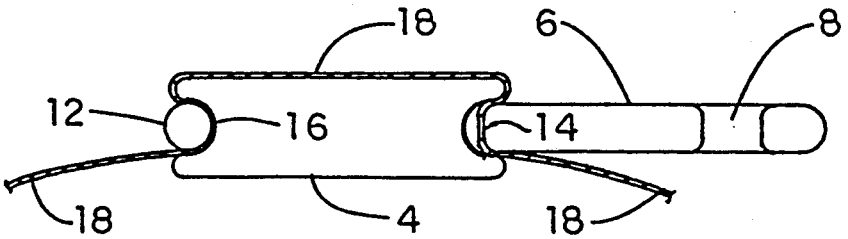
FIG. 5 represents a side elevation view of the snap-on fastener taken along section-line A—A of FIG. 4; and, FIG. 6 represents a perspective view of a film gripped by the snap-on fastener, with a cord attached to the fastener.

FIG. 5, which represents a side section view taken along section line A—A of FIG. 4, illustrates the manner in which a fabric or film 18 is spread over the button 4, and the rim 12 and tongue 6 are then snapped over the fabric 18 which covers button 4, in order to enable the button 4 and frame 2 to securely grip the fabric or film 18. As a general rule, in snapping the button 4 and frame 2 together, it is usually easiest to first snap rim 12 over one end of the button 4 covered by the fabric or film 18 and then snap the concave end 14 of tongue 6 into place on the opposite side of the fabric or film 18 and the underlying button 4. When the button 4 and frame 2 are snapped together, it can be seen that the fabric or film 18 is held securely in place because the fabric or film 18 curls around the groove 16 on both sides of the button 4 and is held there by rim 12 and concave end 14 of tongue 6.

Figure 6:
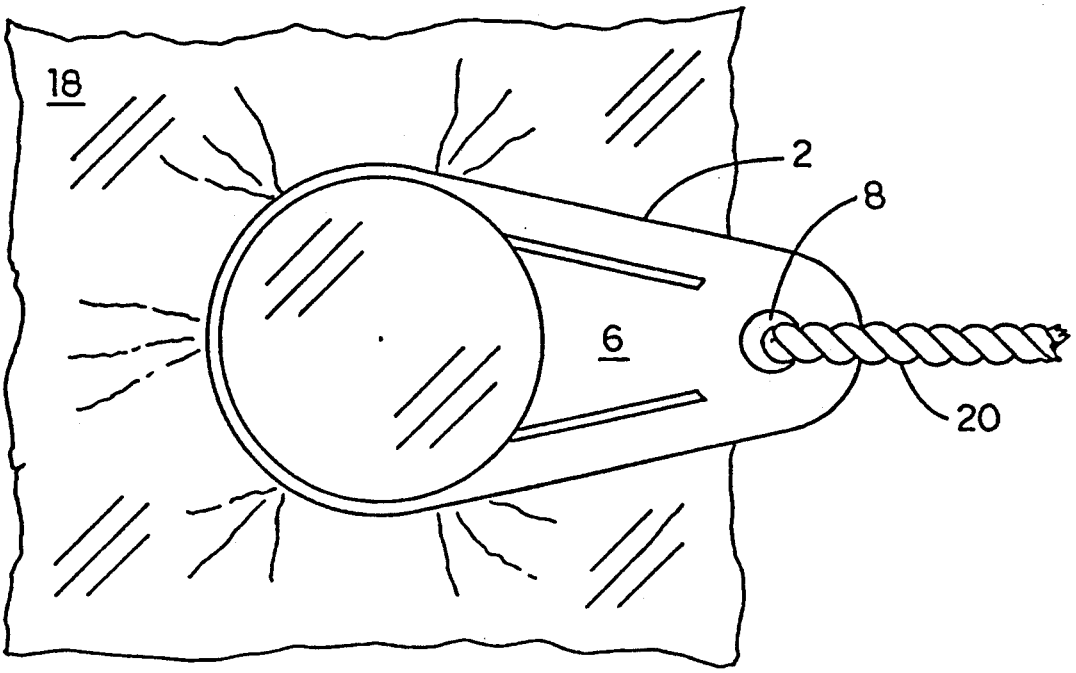

FIG. 6 illustrates a top view of the frame 2 and tongue 6 snapped over fabric or film 18, with the button 4 disposed underneath the fabric 18. A rope 20 is threaded through hole 8 and thus enables the rope 20, or a similar elongated securing device, to be attached indirectly and securely to the fabric by means of the fastener 1 comprising frame 2 and button 4.

EXAMPLE 1

A prototype of the fastener 1 constructed of low density polyethylene and measuring 3½ inches in length, with a button of 1¾ inches diameter, formed in an injection molding machine, has been fastened to a 6 mil sheet of transparent low density polyethylene. It has been found that the prototype could be snapped readily over the film by ordinary hand strength. Once snapped in place, it was found that at least 200 to 300 pounds pull could be applied to a rope secured to the fastener, without the fastener coming apart. Indeed, it was found that the polyethylene sheet would tend to stretch, but there was no evidence that the components of the fastener were beginning to separate. After such a test, the fastener still could be readily snapped apart by ordinary hand strength. No damage to the film or the fastener occurred.

In constructing the prototype and determining the dimensions of it, it was found through trial and error that the length of the projection into the center of the opening was very important to providing good film or fabric gripping action, while at the same time permitting the fastener to be fastened and opened using ordinary hand pressure.

As will be apparent to persons skilled in the art, various modifications and adaptations of the structures above-described are possible without departure from the spirit of the invention, the scope of which is defined in the appended claims.

I claim:

1. A fastening apparatus for gripping web-like materials, comprising:

a generally circular central member having a generally semi-circular cross-section recessed groove formed around its circumference, said central member being generally symmetrical in cross-section through its axis, said central member being adapted for placement on one side of a web-like material; and an outer member including a base, and a frame having a pair of straight leg portions projecting outwardly from said base in coplanar diverging relation and having their ends opposite said base interconnected by a generally semi-circular hoop portion, said frame having a generally circular cross-sectional shape adapted to seat substantially matingly into a first portion of said groove of said central member;

said outer member further including a tongue formed substantially coplanar with said base and said frame, said tongue projecting from said base at a position between said leg portions and having a width which expands in a direction away from said base to substantially fill the space between said leg portions, said tongue terminating in a concavely curved free end presented toward and in spaced relation with said hoop portion, said tongue free end and said hoop portion cooperatively defining a central opening in said outer member of generally circular shape, and said tongue free end being adapted to seat into a second portion of said groove of said central member;

wherein the outer member is adapted for placement onto the opposite side of the web-like material, so that it fits over the central member and the web-like material with said frame hoop portion and said tongue free end seated respectively within said first and second portions of said groove of said central member to securely grip the web-like material, and with said tongue substantially blocking displacement of said leg portions towards each other when the fastening apparatus is subjected to a tension force acting generally along a ling extending between said base and said hoop portion.

2. An apparatus according to claim 1 wherein said base has a second opening formed therein removed from the central member receiving opening.

3. An apparatus according to claim 1 wherein said groove of said central member is bounded at axially opposite sides thereof by a pair of radially outwardly projecting rims of substantially equal diameter.

4. An apparatus according to claim 1 wherein said tongue has a width extending between said leg portions, wherein said tongue width is substantially greater than the cross-sectional thickness of said frame leg portions.

* * * * *